United States Patent [19]

Spoeth, Jr.

[11] 3,971,360

[45] July 27, 1976

[54] INSULATED SERVER

[75] Inventor: Carl R. Spoeth, Jr., Kewaskum, Wis.

[73] Assignee: Dart Industries Inc., Los Angeles, Calif.

[22] Filed: Apr. 24, 1975

[21] Appl. No.: 571,150

[52] U.S. Cl. ..... 126/373; 220/17

[51] Int. Cl.[2] ..... B65D 25/14

[58] Field of Search ..... 220/69, 17, 9 R; 62/457; 126/373, 390

[56] References Cited

UNITED STATES PATENTS

| | | | |
|---|---|---|---|
| 1,363,543 | 12/1920 | Tolbert | 220/17 |
| 2,363,365 | 11/1944 | Schmitt | 220/17 |
| 3,107,028 | 10/1963 | Robertis | 220/69 |
| 3,113,761 | 12/1963 | Platzman | 220/17 |
| 3,882,628 | 5/1975 | Stouder | 220/17 |

FOREIGN PATENTS OR APPLICATIONS

| | | | |
|---|---|---|---|
| 691,191 | 7/1964 | Canada | 220/9 R |

*Primary Examiner*—John J. Camby
*Assistant Examiner*—Larry I. Schwartz
*Attorney, Agent, or Firm*—Kenneth J. Hovet

[57] ABSTRACT

An insulated household vessel for serving hot or cold foodstuffs is provided having a detachable inner liner. The liner includes resilient connectors extending below the bottom into an orifice in the vessel outer casing. The orifice is located in the lower part of a concave portion of the vessel casing thereby facilitating insertion of the connectors and providing a spring-like downward bias on the liner.

7 Claims, 4 Drawing Figures

INSULATED SERVER

BACKGROUND OF THE INVENTION

1. Field of the Invention

The present invention relates to housewares and, more particularly, to an insulated vessel for use in serving hot or cold materials.

2. Description of the Prior Art

Insulated vessels having a large top opening and a removable cover most commonly are used as ice buckets. As such, the materials of construction and the type of inner liner is of little significance since water, i.e., ice, is a substantially inert substance and can be removed by the mere swipe of a towel. However, if one chooses to utilize an insulated container in a more versatile manner as for serving soups, stews, casseroles or other hot items, it becomes necessary to consider ways to facilitate the manner of using, maintaining and cleansing the vessel.

Insulated serving vessels that have removable liners either subject the insulation to contamination or the liner fits loosely within the casing of the vessel thereby making it hazardous to use with hot materials. When transporting, for instance, a hot soup in a removable liner, it has been a problem in that the liner would be unstable and shift around within the casing thereby causing spillage and the like. This is especially onerous in that some of the materials may spill between the liner and casing and contaminate any existing insulation materials and/or cause significant corrosion or sanitary problems.

SUMMARY OF THE INVENTION

The present invention provides an insulated vessel for use in a household suitable for serving hot or cold materials. An outer casing is provided having an inner detachable container or liner. The detachable liner includes a bottom wall from which extends one or more resilient projections which extend through an orifice in the bottom of the vessel casing and which resiliently engage the edges of the orifice. The orifice is located in the bottom of the outer casing and is positioned at the lowermost part of a concave central portion. The removable liner rests on top of the concave portion and the projections extend through the lowermost central orifice and become engaged with the edges thereof whereby the projections are of a length approximately equal to the depth of the concave central portion. In this manner a firm spring-biased engagement of the liner bottom to the casing is effected. The liner is further stabilized by having an outwardly extending annular top rim structure which is concentric with and overlies a peripheral rim flange about the top opening of the vessel housing. The distance between the outer annular rim of the concave portion and the peripheral rim flange of the vessel casing is about equal to the vertical extent of the lining sidewalls. This feature further enhances the placement and firmness of attachment of the liner to the decorative outer casing.

DESCRIPTION OF A PREFERRED EMBODIMENT

Figure 1:
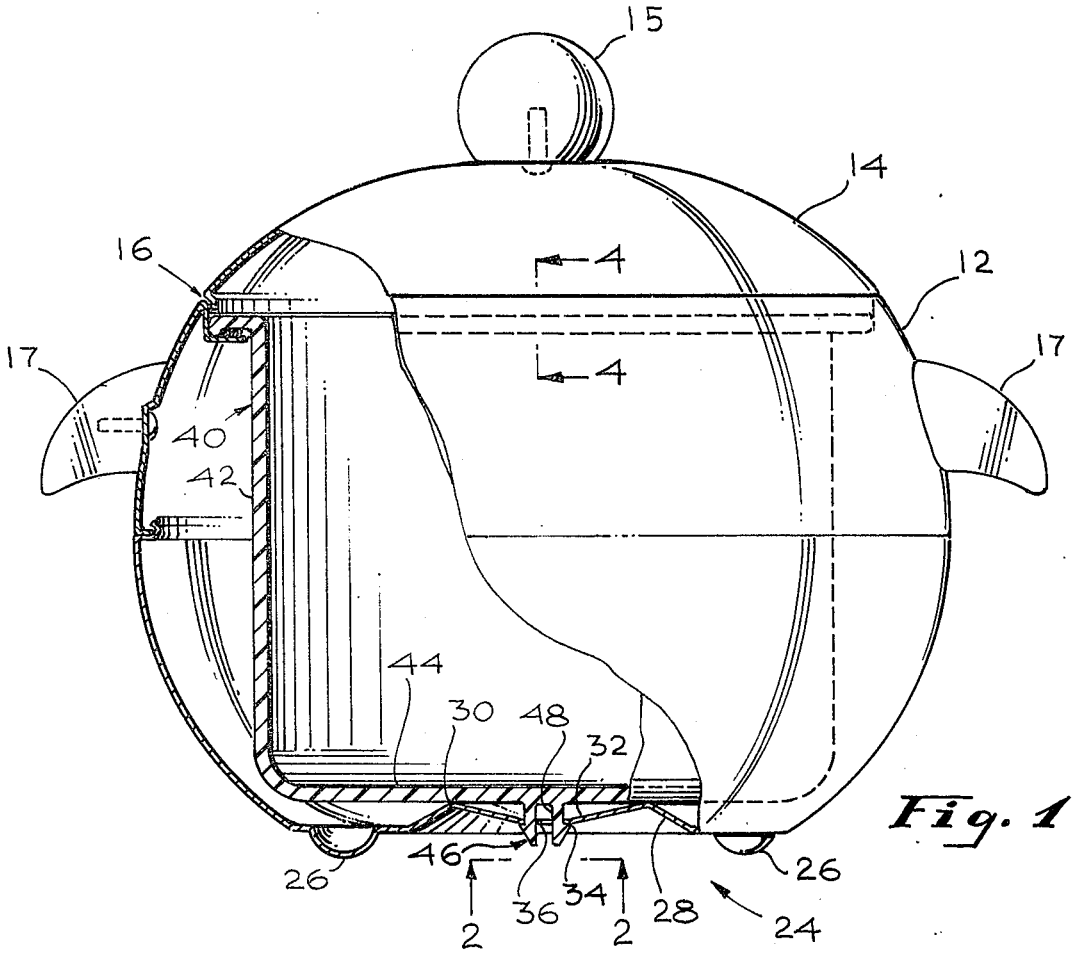
FIG. 1 is a side elevation view partly sectioned showing an insulated serving vessel constructed in accordance with the present invention.
Figure 2:
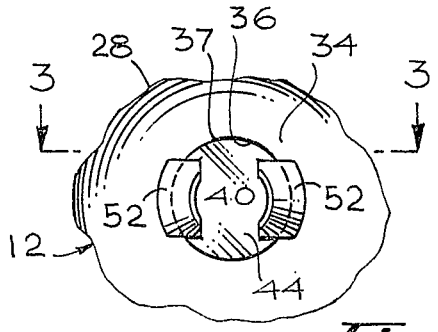
FIG. 2 is an enlarged fragmentary bottom plan view taken along line 2—2 of FIG. 1.
Figure 3:
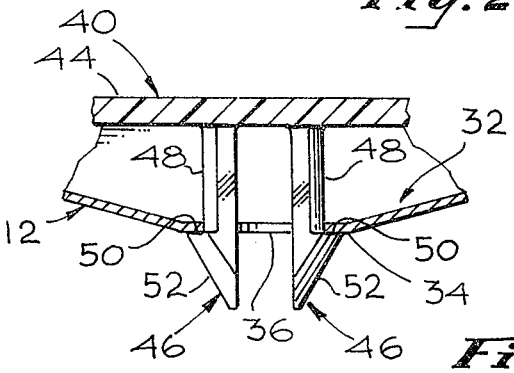
FIG. 3 is a cross-sectional view taken along line 3—3 of FIG. 2.
Figure 4:
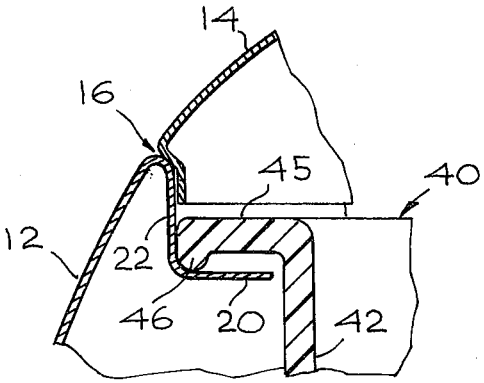
FIG. 4 is a partial sectional view taken along line 4—4 of FIG. 1.

Referring now to the drawings and, more particularly to FIG. 1 thereof, a serving vessel having an outer housing 12 is shown provided with a cover 14 having knob 15. The outer housing is equipped with serving handles 17. It is also provided with a top opening 16 into which the cover 14 interfits. The top opening includes a peripheral rim flange 20 which is integrally connected to the casing 12 by a downwardly extending sidewall 22 of the housing 12.

The base portion 24 of the housing includes support means shown as pads 26 and a central annular upraised section 28. The upraised section is concentric to the top opening 16. The top of the upraised section is defined by an annular rim 30. Extending downwardly from the rim is a concave portion 32 having a lower part 34. The lower part is located a vertical distance above the support pads 26. An orifice 36 is provided at the lowermost portion 34 of the concave portion.

Resting upon said annular rim structure 30 is inner liner 40. The liner includes sidewalls 42 and integral bottom 44. The bottom is provided with at least one or more downwardly extending engagement means 46. As shown, two engagement means are utilized having projections 48 and head sections 52 which are shaped as longitudinal segments of an inverted truncated cone. The base portion 50 of the cone is adapted to overlap the outer edge of orifice 36 thereby providing an engagement surface against the lower part 34.

Due to the conical surfaces of the head sections 52, it can be readily seen that when one positions the liner with the projections over the orifice 36, it is a simple matter to simply push axially downwardly causing the projections to be deflected inwardly until they reach a point where the base of the cone is beyond the orifice. When this occurs, the projections, due to their inherent resilience, snap outwardly to their original position and engage the edges 37 of the orifice 36. When one wishes to remove the liner 40, a simple squeezing action pushing together the projections so that the step portions 50 are within the diameter of the orifice 36 allows for disengagement from the orifice edges and upward movement through the orifice. In this manner the liner can be lifted out of the housing 12 for cleansing, filling or the like.

It will be appreciated that the distance between the step portions 50 and the bottom 44 of the liner is about equal to or slightly less than the distance between the annular rim 30 and lowermost portion 34. This allows for a tension to be created between the liner bottom 44 and casing concave portion 34. Of course this results in a spring-like bias to create a strong axial connection between the liner and vessel housing.

The sidewalls 42 of the liner 40 extend upwardly and merge into an outwardly extending annular rim structure 45. The outer end 46 of the liner rim is of a diameter slightly less than the inside diameter of sidewall 22. This allows the liner to fit snugly within the top opening with a minimum of free lateral movement.

It will further be understood that the vertical length of the sidewalls is about equal to the vertical distance between the rim flange 20 and the base portion annular rim 30. This allows the liner rim 45 which overlies the flange 20 to exert a downward axial tension thereagainst. The effect is to further enhance the engagement between the liner and vessel housing, which discourages contaminate entrapment between the outer housing and liner.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiment but only by the scope of the appended claims.

I claim:

1. An insulated server having an outer housing with a top opening defined by a peripheral rim flange and a base portion having an orifice therethrough and support means for said server including a removable inner liner having a bottom and upstanding integral sidewalls, said bottom having an integral downwardly extending engagement means for releasable attachment to the base portion of said server comprising at least one projection with an enlarged head for passing through said orifice, said head including a step portion for engaging the edges of said orifice.

2. The server of claim 1 wherein the base portion of said server includes a central annular upraised section extending into a top annular rim and downwardly into an inner concave portion, the lower part of which is spaced above the server support means.

3. The server of claim 2 wherein said server top opening and said inner concave portion are circular and concentric to each other and said orifice is located in the center of said concave portion.

4. The server of claim 1 wherein said engagement means includes two resilient projections spaced apart a distance about equal to the diameter of said orifice, the head of each projection having the shape of a longitudinal segment of an inverted truncated cone.

5. The server of claim 3 wherein said engagement means includes two resilient projections spaced apart a distance about equal to the diameter of said orifice, the head of each projection having the shape of a longitudinal segment of an inverted truncated cone.

6. The server of claim 4 wherein the bottom of said liner rests upon said top annular rim and the length of each projection is about equal to the depth of said concave portion.

7. The server of claim 3 wherein the sidewalls of said liner merge into an outwardly extending rim which overlies said housing peripheral rim flange, said sidewalls having a vertical length about equal to the distance between said housing rim flange and said base portion top annular rim.

* * * * *